US007219603B2

(12) United States Patent
Ishikawa

(10) Patent No.: US 7,219,603 B2
(45) Date of Patent: May 22, 2007

(54) INK SUPPLY UNIT FOR A FLEXOGRAPHIC PRESS

(75) Inventor: Teiichirou Ishikawa, Ota-ku (JP)

(73) Assignee: Kabushiki Kaisha Taiyo Kikai Seisakusho, Ota-ku, Tokyo (JP)

( * ) Notice: Subject to any disclaimer, the term of this patent is extended or adjusted under 35 U.S.C. 154(b) by 79 days.

(21) Appl. No.: 10/946,888

(22) Filed: Sep. 22, 2004

(65) Prior Publication Data

US 2005/0223923 A1 Oct. 13, 2005

(30) Foreign Application Priority Data

Apr. 6, 2004 (JP) ..... 2004-111924

(51) Int. Cl.
*B41F 31/04* (2006.01)
*B41F 31/30* (2006.01)

(52) U.S. Cl. ..... 101/351.3; 101/350.6; 101/351.1; 101/363

(58) Field of Classification Search ..... 101/350, 101/352.09, 352.04, 351.3, 352.11, 352.13, 101/351.1, 351.2, 351.4, 352.01, 352.02, 101/352.03, 352.05, 335, 348, 349.1, 350.1, 101/363, 364, 365
See application file for complete search history.

(56) References Cited

U.S. PATENT DOCUMENTS 4,481,883 A * 11/1984 Savart et al. ..... 101/363
5,848,570 A * 12/1998 Koppelkamm et al. .. 101/351.3
5,983,797 A * 11/1999 Secor ..... 101/350.6
6,076,462 A * 6/2000 Schafer et al. ..... 101/350.6
6,557,465 B2 * 5/2003 Baum ..... 101/174
6,862,988 B2 * 3/2005 Dylia et al. ..... 101/351.3
2004/0187718 A1 * 9/2004 Ross et al. ..... 101/350.6

FOREIGN PATENT DOCUMENTS

JP 9-201952 8/1997
JP 10-296961 11/1998
JP 10-296962 11/1998

* cited by examiner

*Primary Examiner*—Leslie J. Evanisko
(74) *Attorney, Agent, or Firm*—DeLio & Peterson, LLC

(57) ABSTRACT

An ink supply unit for a flexographic press that is convenient for exchange of an anilox roll and an order of colors to be printed is disclosed. A time for test printing can be shortened, thereby enhancing a working efficiency. A pivot frame can move between a printing position where an anilox roll is mounted on a stationary frame to engage a printing cylinder and an exchanging position where the anilox roll is spaced away from the stationary frame to disengage the printing cylinder. An ink level of a maximum amount of ink contained in an ink chamber is located near a contact position between an upper doctor blade and the anilox roll, when the pivot frame is located at the printing position. The ink level is located below a lower doctor blade, when the pivot frame is located at the exchanging position.

6 Claims, 4 Drawing Sheets

INK SUPPLY UNIT FOR A FLEXOGRAPHIC PRESS

BACKGROUND OF THE INVENTION

This invention relates to an ink supply unit for supplying ink to a printing cylinder in a flexographic press, and more particularly relates to an ink supply unit suitable for an open chamber type ink supply unit.

As well known in a flexographic press, increase or decrease of a supply amount of ink to a printing cylinder and roughness or denseness of printing essentially depend on an anilox roll to be used. Thus, it is necessary to exchange an anilox roll and carry out a test-printing for duration in time from a test-printing step to a regular printing step. In the case of exchanging the anilox roll, whether the ink supply unit is an open chamber type or a closed chamber type, it was necessary to remove ink in the chamber every time. This required a time and a troublesome work. In another case, it was necessary to change an order of colors to be printed. This required for washing the anilox roll and an interior of the chamber.

Patent Documents that will be related to the present invention are cited below:

Patent Document 1 Japanese Patent Public Disclosure No. 9-201952 (1997)

Patent Document 2 Japanese Patent Public Disclosure No. 10-296961 (1998)

Patent Document 3 Japanese Patent Public Disclosure No. 10-296962 (1998)

Accordingly, an object of the present invention is to provide an ink supply unit for a flexographic press that can readily exchange an anilox roll or an order of colors to be printed, thereby reducing a time for a test-printing process and enhancing a working efficiency.

Still other objects and advantages of the invention will in part be obvious and will in part be apparent from the specification.

SUMMARY OF THE INVENTION

An ink supply unit for a flexographic press in accordance with the present invention comprises: an ink chamber including a pair of upper and lower doctor blades; an anilox roll for supplying ink contained in the ink chamber to a printing cylinder; a pivot frame for holding the ink chamber and the anilox roll at a given position, respectively; and a stationary frame mounted on a bed for being rotatably coupled to an end of the pivot frame.

The anilox roll is detachably mounted on the pivot frame for exchanging the roll. The pivot frame can move between a printing position where the anilox roll is mounted on a stationary frame to engage the printing cylinder and an exchanging position where the anilox roll is spaced away from the stationary frame to disengage the printing cylinder. An ink level of a maximum amount of ink contained in the ink chamber is located near a contact position between the upper doctor blade and the anilox roll when the pivot frame is located at the printing position. The ink level is located below the lower doctor blade when the pivot frame is located at the exchanging position.

Preferably, the stationary frame is slidably mounted on the bed and the stationary frame can move between the printing position where the anilox roll engages the printing cylinder and a displaced position where the anilox roll is spaced away from the printing cylinder. On the other hand, in the case where the ink supply unit is an open chamber type ink supply unit, the ink chamber may be detachably mounted on the pivot frame, or the pivot frame may be detachably mounted on the stationary frame, or the pivot frame and ink chamber may be detachably mounted on the stationary frame and pivot frame respectively.

When exchanging the anilox roll, the pivot frame is moved from the printing position to the pivoted position and the level of the ink contained in the ink chamber is lowered below the lower doctor blade. Consequently, it is possible to surely prevent the ink from being spilt from a space between the doctor blades defined by removing the anilox roll during a process of removing the anilox roll. This requires no process of drawing the ink from the ink chamber, thereby enhancing a working efficiency.

Since the stationary frame is slidably mounted on the bed, it is possible to freely move the pivot frame upward from the printing position to the pivoted position, after the anilox roll is moved away from the printing cylinder. This makes it possible to move the pivot frame from the printing position to the pivoted position, even if a contact point between the anilox roll and the printing cylinder is located below the rotary axle that is a rotary center of the printing cylinder. This means that the ink supply unit of the present invention can be applied to any printing cylinders having different roll diameters. It is also possible to set a pressure that the anilox roll applies to the printing cylinder to be a desired value by adjusting a displacement amount of the pivot frame.

In the case where the ink supply unit is an open chamber type ink supply unit, when the ink in the ink chamber should be exchanged, if desired, the ink chamber is removed from the pivot frame and another ink chamber containing the desired ink is mounted on the pivot frame. It is also possible to enlarge a space for washing the anilox roll. At this time, since the ink is maintained in the ink chamber, as mentioned above, it is possible to prevent the ink from spilling from the ink chamber accidentally.

On the other hand, in the case where the pivot frame is detachably mounted on the stationary frame, it is possible to exchange the ink by removing the pivot frame which mounts the anilox roll and ink chamber from the stationary frame and by substituting an assembly including an anilox roll, an ink chamber, and a pivot frame, that was used in the ink supply unit for desired ink, for the previous ink supply unit.

BRIEF DESCRIPTION OF THE DRAWINGS

The features of the present invention believed to be novel and the elements characteristic of the present invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DETAILED DESCRIPTION OF THE PREFERRED EMBODIMENTS

Figure 1:
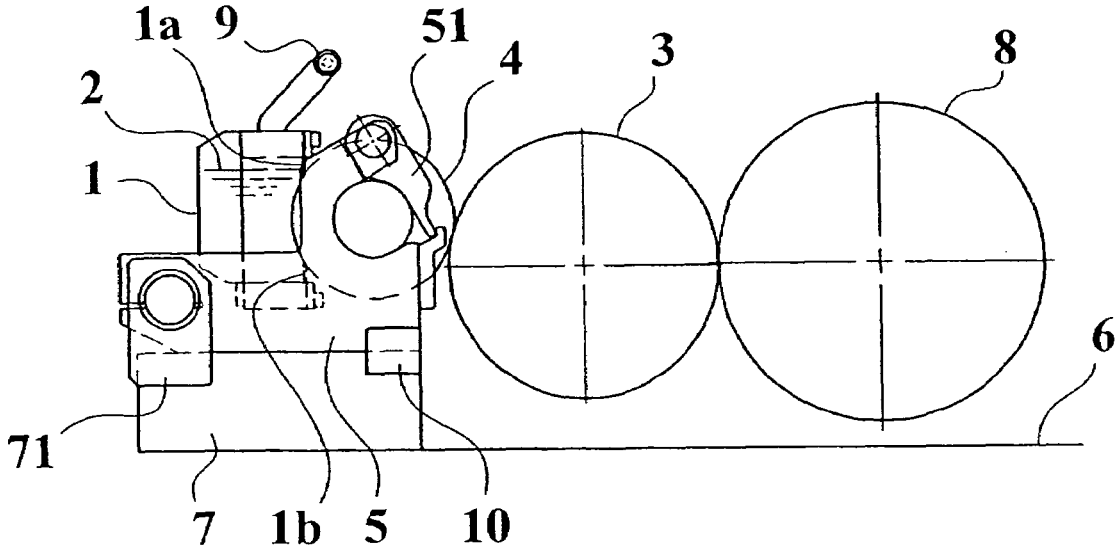
FIG. 1 is a schematic side elevation view of a first embodiment of an ink supply unit for a flexographic press in accordance with the present invention.

In describing the preferred embodiments of the present invention, reference will be made herein to FIGS. 1 to 4 of the drawings in which like numerals refer to like features of the invention. Features of the invention are not necessarily shown to scale in the drawings.

Figure 2:
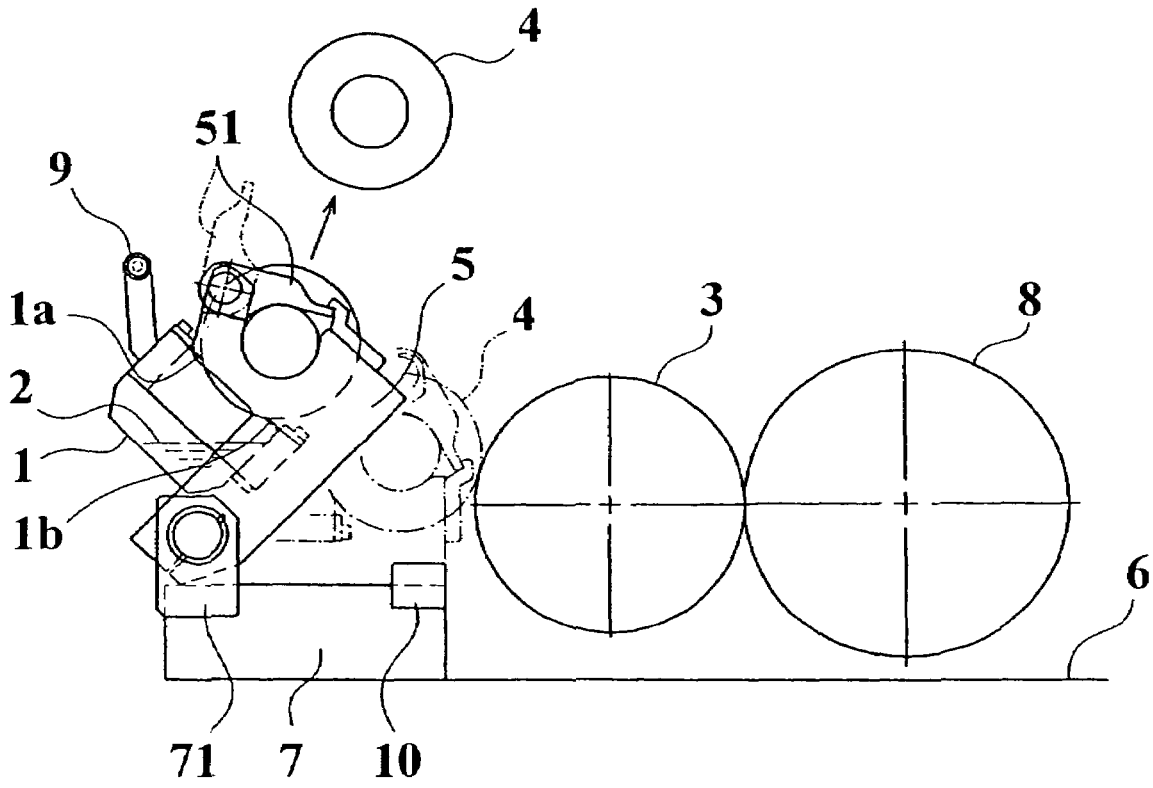
FIG. 2 is a schematic side elevation view similar to FIG. 1, illustrating the ink supply unit being moved.
Figure 4:
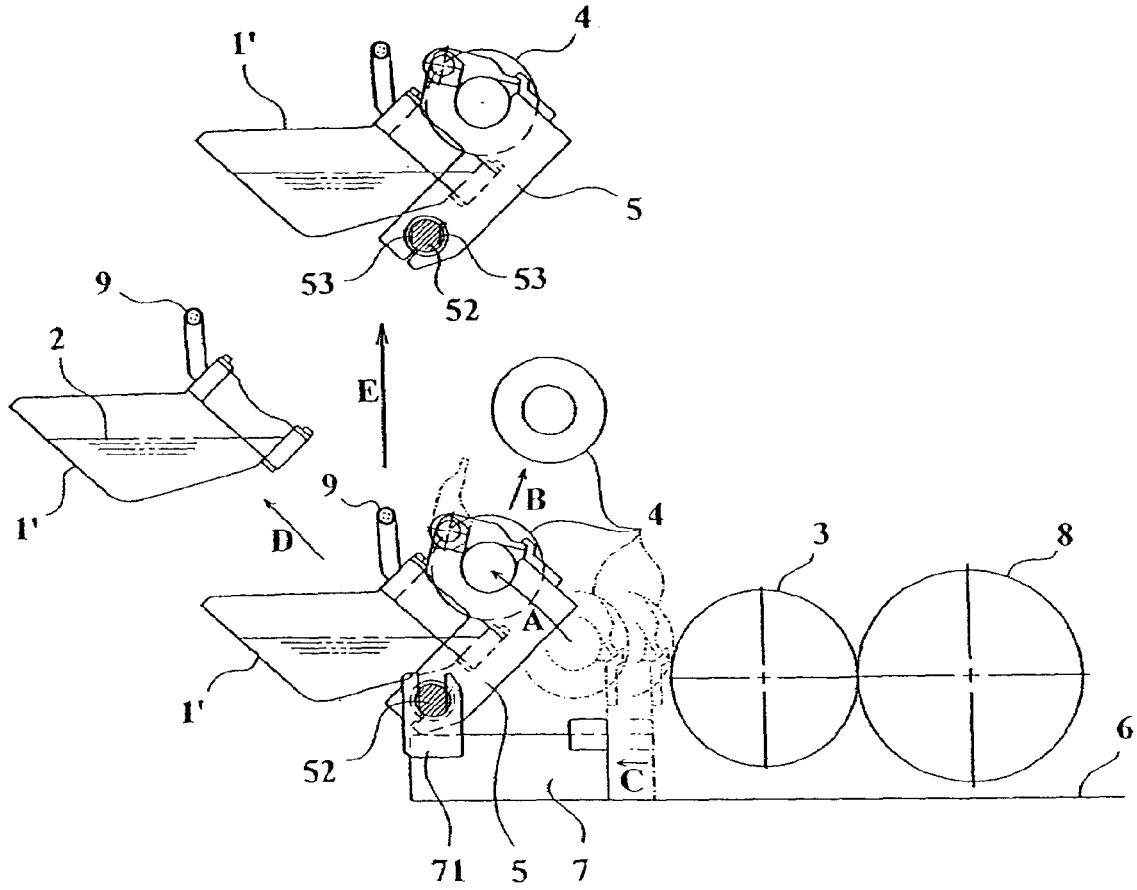
FIG. 4 is a schematic side elevation view similar to FIG. 3, illustrating the ink supply unit being moved.

FIGS. 1 and 2 show a first embodiment of an ink supply unit for a flexographic press in accordance with the present invention. The ink supply unit in the first embodiment is illustrated and described here as a configuration of a closed chamber type ink supply unit. However, it will be apparent from the description mentioned below that the present invention can be also applied to an open chamber type ink supply unit. As shown in the drawings, the ink supply unit comprises an ink chamber 1 including a pair of upper and lower doctor blades 1*a* and 1*b*, an anilox roll 4 for supplying ink 2 contained in the ink chamber 1 to a printing cylinder 3, a pivot frame 5 for holding the ink chamber 1 and anilox roll 4 at given positions, respectively, and a stationary frame 7 mounted on a bed 6 and rotatably coupled to an end, of the pivot frame 5. An impression cylinder 8 serves to press a continuous paper (not shown), which runs between the impression cylinder 8 and the printing cylinder 3, against a printing plate on the printing cylinder 3. Preferably, the stationary frame 7, as shown in FIG. 4, is slidably mounted on the bed 6 to be displaced relative to the printing cylinder 3. This structure can avoid interference between the printing cylinder 3 and the ink supply unit upon exchange of the printing cylinder 3 and also cab keep a desired relationship in engagement with any printing cylinders having various roll diameters.

Since the anilox roll 4 will directly affect increase or decrease of a supply amount of ink and roughness or denseness of printing, it is necessary to exchange the anilox roll 4, if desired. Thus, a releasable lock lever 51 installs the anilox roll 4 in a bearing of the pivot frame 5 detachably and rotatably. The pivot frame 5 is rotatably coupled to a support arm 71 of the stationary frame 7 and mounted on the stationary frame 7. The pivot frame 5 can rotate between a printing position (FIG. 1) where the anilox roll 4 engages the printing cylinder 3 and an exchanging position (FIG. 2) where the anilox roll 4 is spaced away from the stationary frame 7 to disengage the printing cylinder 3. The level of a maximum amount of ink contained in the ink chamber 1 is located near a contact position between the upper doctor blade la and the anilox roll 4, when the pivot frame 5 is located on the printing position. The ink level is located below the lower doctor blade 1*b*, when the pivot frame 5 is located on the exchanging position.

A handle 9 serves to rotate the pivot frame 5 between the printing position and the exchanging position. A position-holding member 10 serves to lock the pivot frame 5 releasably at the printing position. On the other hand, it is preferable to provide a lock means (not shown) for preventing the pivot frame 5 from shifting out of the exchanging position accidentally, when the pivot frame 5 is rotated to the exchanging position.

The ink supply unit of the present invention as constructed above begins to print while the pivot frame 5 is held at the printing position, as shown in FIG. 1. In the case where the anilox roll 4 should be exchanged, after the pivot frame 5 is rotated from the printing position to the exchanging position by operating the handle 9 by an operator, the lock lever 51 is opened and the used anilox roll 4 is removed. Then, after another anilox roll 4 is installed, the lock lever 51 is closed and the pivot frame 5 is returned to and secured to the printing position.

Figure 3:
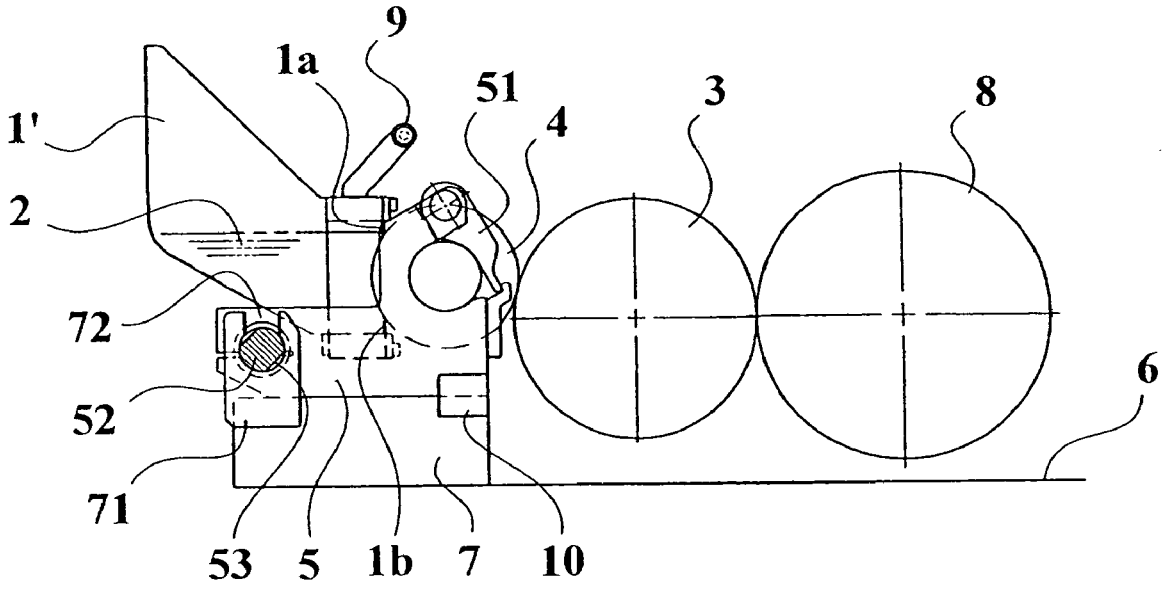
FIG. 3 is a schematic side elevation view of a second embodiment of an ink supply unit for a flexographic press in accordance with the present invention.

FIGS. 3 and 4 show a second embodiment of an ink supply unit for a flexographic press in accordance with the present invention. In particular, the second embodiment of the ink supply unit is suitable for an open chamber type ink supply unit.

The second embodiment of the ink supply unit has the substantially same construction as that of the first embodiment except that an ink chamber 1' for containing ink is detachably mounted on the pivot frame 5 and that the pivot frame 5 is detachably mounted on the stationary frame 7. The stationary frame 7 is slidably mounted on the bed 6 so that the stationary frame 7 can be displaced relative to the impression cylinder 8 on the bed 6, as described above in the first embodiment.

A mechanism for detachably mounting the ink chamber 1' on the pivot frame 5 is one of features of the second embodiment of the ink supply unit. The mechanism may include a well-known assembly comprising a guide rail and a slider, but it is not limited to the assembly. However, it will be preferable that a mechanism for coupling the ink chamber 1' and pivot frame 5 to each other when the ink chamber 1' is mounted on the pivot frame 5, for example, a releasable lock mechanism, serves to hold the pivot frame 5 at a predetermined position. As described above in the first embodiment, the level of a maximum amount of ink contained in the ink chamber 1' is located near a contact position between the upper doctor blade la and the anilox roll 4, when the pivot frame 5 is located on the printing position (FIG. 3). The ink level is located below the lower doctor blade 1*b*, when the pivot frame 5 is located on the exchanging-position (FIG. 4).

A mechanism for detachably mounting the pivot frame 5 on the stationary frame 7 is also one of the features of the second embodiment. Any mechanism for detachably and rotatably mounting the pivot frame 5 on the stationary frame 7 may be applied to the second embodiment. In the illustrated embodiment, a pair of opposed parallel flat surfaces 53 are provided on a rotary axle 52 of the pivot frame 5. An engaging groove 72 having the substantially same width as the distance between the flat surfaces 53 is formed in a receiving portion of a support arm 71 of the stationary frame 7 to receive the rotary axle 52 of the pivot frame 5.

In order to attach the pivot frame 5 to the stationary frame 7, the rotary axle 52 is displaced to the bearing portion of the support arm 71 with the flat surfaces 53 of the rotary axle 52 coinciding with the side edges of the engaging groove 72. Then, the pivot frame 5 is rotated to the printing position while rotating the rotary axle 52 in the bearing portion of the support arm 71, thereby coupling the pivot frame 5 to the stationary frame 7. In order to detach the pivot frame 5 from the stationary frame 7, the pivot frame 5 is rotated to the exchanging position so that the flat surfaces 53 of the rotary axle 52 coincide with the side edges of the engaging groove 72. The rotary axle 52 is rotated in the engaging groove 72 to be disconnected from the support arm 71, thereby decoupling the pivot frame 5 from the stationary frame 7. It will be apparent from the above operation that the flat surfaces 53 of the rotary axle 52 coincide with the side edges of the engaging groove 72 when the pivot frame 5 is rotated to the exchanging position. A stopper (not shown) is provided so that the pivot frame 5 stops rotating at the exchanging position.

Although the handles 9 may be provided on the ink chamber 1' and the pivot frame 5, respectively, it is preferably to provide a single handle 9 only on the ink chamber 1' so that a single handle can carry out detachment of the ink chamber 1' and rotation and detachment of the pivot frame 5. An attachment position of the handle 9 on the ink chamber 1' should be decided so that the ink contained in the ink chamber 1' is not spilt from the chamber, when an operator grasps the handle 9 by the operator's hand and detaches the ink chamber 1' from the stationary frame 7 and when the operator detaches the pivot frame 5 on which the ink chamber 1' and anilox roll 4 are still mounted on the stationary frame 7.

In the second embodiment of the ink supply unit constructed above, the pivot frame 5 is rotated to the exchanging position in a direction shown by an arrow A in the same manner as the first embodiment, and then the anilox roll 4 is exchanged in a direction shown by an arrow B. At this time, it will be preferable to rotate the pivot frame 5, after the ink supply unit is displaced in a direction shown by an arrow C on the bed 6 from a position engaging with the printing cylinder 3 for carrying out a regular printing to a position spaced away from the engaging position. This will avoid interference of printing cylinder 3 against rotation of the pivot frame 5, for example, in the case where an engaging position between the anilox roll 4 and the printing cylinder 3 is located below a height passing the center of the printing cylinder 3 on account of a roll diameter of a printing cylinder 3 to be used. On the other words, since the ink supply unit can be displaced on the bed 6, it is possible to utilize any printing cylinder 3 without taking a roll diameter into consideration. When an operator grasps the handle 9 by the operator's hand and displace the ink chamber 1' to a given direction shown by an arrow D, the ink chamber 1' is removed from the pivot frame 5. Similarly, when an operator grasps the handle 9 by the operator's hand and displace the pivot frame 5 to a given direction shown by an arrow E, the pivot frame 5 is removed from the stationary frame 7.

The present invention can be applied to a rotary press utilizing the similar ink supply unit, such as a letterpress printing machine, a planographic printing machine, or an intaglio-printing machine.

The entire disclosure of Japanese Patent Application No. 2004-111924 filed on Apr. 6, 2004 including the specification, claims, drawings and summary is incorporated herein by reference in its entirety.

While the present invention has been particularly described, in conjunction with a specific preferred embodiment, it is evident that many alternatives, modifications, and variations will be apparent to those skilled in the art in light of the foregoing description. It is therefore contemplated that the appended claims will embrace any such alternatives, modifications, and variations as falling within the true scope and spirit of the present invention.

Thus, having described the invention, What is claimed is:

1. An ink supply unit for a flexographic press comprising:

an ink chamber including an upper doctor blade and a lower doctor blade, each doctor blade having a free end and an opening between the free ends; an anilox roll for supplying an ink contained in said ink chamber to a printing cylinder; a pivot frame for holding said ink chamber and said anilox roll at given positions, respectively with the free ends of each doctor blade contacting the anilox roll so that the opening between the free ends communicates with the anilox roll; and a stationary frame mounted on a bed and rotatably coupled to an end of said pivot frame by a rotary axle received in a support arm of the stationary frame;

said anilox roll being detachably mounted on said pivot frame;

said pivot frame being able to move between a printing position where said anilox roll is mounted on the stationary frame to engage said printing cylinder and an exchanging position where said anilox roll is spaced away from said stationary frame to disengage said printing cylinder;

said pivot frame also being detachably mounted on said stationary frame wherein the rotary axle of the pivot frame has a pair of opposed parallel flat surfaces having substantially the same width as side edges of an engaging groove in the support arm whereby the pivot frame is rotatably coupled to the stationary frame by displacing the opposed parallel flat surfaces of the axle with the side edges of the engaging groove then rotating the pivot frame to the printing position while rotating the rotary axle in the support arm thereby coupling the pivot frame to the stationary frame; and an ink level of a maximum amount of ink contained in said ink chamber, the level being located near a contact position between said upper doctor blade and said anilox roll when said pivot frame is located at said printing position, and said ink level being located below the contact position between said lower doctor blade and the anilox roll when said pivot frame is located at said exchanging position.

2. An ink supply unit for a flexographic press according to claim 1, wherein said stationary frame is slidably mounted on said bed and said stationary frame can move between said printing position where said anilox roll engages said printing cylinder and a displaced position where said anilox roll is spaced away from said printing cylinder.

3. An ink supply unit for a flexographic press according to claim 2, wherein said ink supply unit is an open chamber type ink supply unit, and said ink chamber is detachably mounted on said pivot frame.

4. An ink supply unit for a flexographic press according to claim 2, wherein said ink supply unit is an open chamber type ink supply unit.

5. An ink supply unit for a flexographic press according to claim 1, wherein said ink supply unit is an open chamber type ink supply unit and said ink chamber is detachably mounted on said pivot frame.

6. An ink supply unit for a flexographic press according to claim 1, wherein said ink supply unit is an open chamber type ink supply unit.

* * * * *

UNITED STATES PATENT AND TRADEMARK OFFICE

CERTIFICATE OF CORRECTION

PATENT NO. : 7,219,603 B2
APPLICATION NO. : 10/946888
DATED : May 22, 2007
INVENTOR(S) : Teiichirou Ishikawa It is certified that error appears in the above-identified patent and that said Letters Patent is hereby corrected as shown below:

In the Specification:

Column 3, line 31, delete “cab” and substitute therefor -- can --.

Column 4, line 19, before “features” insert therefor -- the --.

Column 5, line 27, delete “On the other words” and substitute therefor -- In other words --.

Signed and Sealed this

Twenty-ninth Day of January, 2008

JON W. DUDAS
*Director of the United States Patent and Trademark Office*